United States Patent [19]

Hile

[11] 4,114,147

[45] Sep. 12, 1978

[54] CODE COMBINATION PROPERTY ALARM SYSTEM

[76] Inventor: John R. Hile, 115 Mulberry St., Inman, S.C. 29349

[21] Appl. No.: 780,841

[22] Filed: Mar. 24, 1977

[51] Int. Cl.[2] ..... G08B 29/00

[52] U.S. Cl. ..... 340/528; 340/543

[58] Field of Search ..... 340/274 C, 274 R, 276, 340/420

[56] References Cited

U.S. PATENT DOCUMENTS

| | | | |
|---|---|---|---|
| 3,544,987 | 12/1970 | McMann, Jr. et al. | 340/276 |
| 3,881,171 | 4/1975 | Moorman et al. | 340/274 C |

*Primary Examiner*—Glen R. Swann, III

*Attorney, Agent, or Firm*—Schuyler, Birch, Swindler, McKie & Beckett

[57] ABSTRACT

A property protection alarm system is disclosed for protecting property against unauthorized intrusion and the like. The alarm system includes a numeric key board and a code combination logic circuit for arming an alarm energization circuit in response to the proper entry of a predetermined numeric code in the numeric keyboard. This predetermined code must be entered within a given period of time determined by the code combination logic circuit. In addition, the numeric key associated with the last digit of the predetermined code must be depressed for a given period of time as also determined by the code combination logic circuit. An exit delay circuit is connected to the output of the code combination logic circuit for delaying the arming of the alarm energization circuit in order to permit an authorized operator to leave the property without energizing the alarm. The alarm energization circuit is connected to a sensing circuit for sensing any intrusion of the property. The alarm energization circuit is capable of triggering a local alarm upon any intrusion of the property including an authorized intrusion. On the other hand, the alarm energization circuit includes an entrance delay circuit which delays the energization of an external alarm to enable an authorized user to disarm the alarm energization circuit by entering the predetermined numeric code in the numeric keyboard before the expiration of the time period provided by the entrance delay circuit.

10 Claims, 6 Drawing Figures

CODE COMBINATION PROPERTY ALARM SYSTEM

BACKGROUND OF THE INVENTION The present invention is directed to a property protection alarm system for protecting property against any unauthorized intrusion. Although this alarm system is primarily intended to detect such intrusions, other alarm conditions also can be conveniently detected by the alarm system of the present invention.

Many different types of property protection alarm systems for protecting property against intrusion and similar alarm conditions are presently known and available. Some of these known alarm systems include a code combination unit for arming and disarming the alarm circuit in response to the entry of a predetermined code. For example, U.S. Pat. No. 2,855,588, issued to Allen on Oct. 7, 1958, shows a combination lock and burglar alarm having a coder unit for disabling the alarm circuit in response to the sequential operation of a plurality of preselected push buttons within a predetermined time period. The coder unit of the Allen patent is associated with a lock positioned at the entrance to the property. The proper entry of the predetermined code in the coder unit not only disables the alarm system but also enables the operator to unlock the lock and enter the premises. Other known alarm systems also employ coder units similar to the coder unit in the Allen patent to arm as well as to disarm the alarm system. In these other alarm systems, the coder units are often positioned inside the protected property, e.g., inside a residence. In this manner, the alarm system can be armed by an authorized operator before leaving the property by providing, in addition to the coder unit, an exit delay circuit for enabling the authorized operator to leave the premises without setting off the alarm. In addition, it is known to use an entrance delay circuit to enable the authorized operator to reenter the property without setting off the alarm circuit. The delay provided by the entrance delay circuit gives the authorized operator a predetermined time period in which to enter the preselected code in the coder unit and disarm the alarm system. For example, a very complicated and sophisticated arrangement of this type is shown in U.S. Pat. No. 3,978,478, issued to Schmitz on Aug. 31, 1976. As explained in the Schmitz patent, the authorized operator enters the preselected code by actuating the appropriate code keys of the numeric keyboard. Following the expiration of a given time period determined by an exit delay circuit (FIG. 6), the alarm circuit is energized. Likewise, upon returning to the property, the authorized operator is given a limited period of time to enter the preselected code in order to disarm the alarm circuit. During both the exit delay period and the entrance delay period, the alarm circuit remains inactive and no alarm is sounded.

One of the disadvantages of this alarm system is that the occupants of the property are not immediately warned of the intrusion of the property. Such warning occurs only after a given delay period. In addition, the complexity and sophistication of the Schmitz patent makes the alarm system impractical for many applications.

In addition to the coding features provided by the above prior art, other known alarm systems provide an alarm circuit for energizing both an external alarm and a local alarm. For example, the external alarm may be located immediately outside the protected property or may be located at some remote point. Generally, the local alarm is located inside the property in order to warn the occupants of the property of an intrusion or some other alarm condition. One known prior art alarm system shows two different local alarms for enabling the occupants to distinguish between an authorized and an unauthorized intrusion of the property. This alarm system is shown in U.S. Pat. No. 3,544,987, issued to McMann on Dec. 1, 1970. The McMann alarm system is a combination of a coder unit similar to those described above for arming and disarming the alarm circuit and two different audible local alarms. Upon arming the alarm circuit in the McMann patent, the first audible or alert alarm is immediately energized. The energization of the other audible alarm is delayed to permit the authorized operator to leave the property. Henceforth, any intrusion of the property will immediately trigger the alert audible alarm and will trigger the other audible alarm after the expiration of a given delay period. One of the disadvantages of the McMann alarm system is that, although it is desirable to have a local audible alarm immediately energized upon any intrusion of the premises, it is disturbing to the other occupants of the property to have this same audible alarm energized when the alarm circuit is initially armed by the entry of the preselected code. In addition, it is often desirable to locate one of these alarms in an external location rather than centralizing all of the alarms energized by the alarm circuit.

Accordingly, it is an object of the present invention to provide a property protection alarm system which overcomes the disadvantages of the prior art alarm systems described above. In particular, it is an object of the present invention to provide an alarm system having an alarm circuit including both an external alarm and a local audible alarm in which the local audible alarm is only energized in response to an intrusion of the property after the alarm circuit is armed. In addition, it is an object of the present invention to provide an alarm system including a code combination logic circuit for arming and disarming the alarm circuit in response to the entry of a predetermined code in a numeric keyboard. The improved alarm system of the present invention enables an authorized operator to arm the alarm circuit and leave the premises without energizing either the local audible alarm or the external alarm. Then, any subsequent intrusion of the property, including entry by the authorized operator, immediately energizes the local audible alarm to warn other occupants of the property of such intrusion while at the same time providing the authorized operator a given period of time in which to prevent the energization of the external alarm.

Another object of the present invention is to provide an alarm system which is armed by the entry of a predetermined code in a numeric keyboard within a given period of time and in a predetermined sequence. In this regard, it is an object of the present invention to provide a code combination logic circuit requiring the authorized operator, upon entering the predetermined code, to actuate one of the digits of the predetermined code for a given period of time in order to enable the code combination logic circuit to arm the alarm circuit.

It is a further object of the present invention to provide visual display means in proximity to the numeric keyboard for indicating that the alarm system has been armed by the entry of the proper predetermined code.

A final object of the present invention is to provide an automatic periodic test circuit for determining whether the alarm condition which actuates the alarm circuit continues to exist and for automatically deenergizing the local audible alarm and the external alarm circuit if the test circuit determines that the alarm condition has been eliminated.

SUMMARY OF THE INVENTION

This invention is a property protection alarm system for protecting property against alarm conditions including any unauthorized intrusion of the property. The property protection alarm system of the present invention combines an alarm circuit having both a local audible alarm and an external alarm with a code combination circuit for arming and disarming the alarm circuit in response to the proper entry of a predetermined sequential code in the code combination circuit within a given period of time. In addition, the predetermined code of the code combination circuit of the present invention includes at least one digit which must be actuated by an authorized operator for a predetermined period of time in order for the code combination circuit to arm and disarm the alarm circuit. The alarm system of the present invention also includes an exit delay timer for permitting an authorized operator to enter the predetermined code and leave the property without setting off either the local audible alarm or the external alarm. An entrance delay circuit is also included in the alarm system to enable an authorized operator to enter the property and insert the predetermined code in the code combination circuit in order to disarm the alarm circuit and prevent the energization of the external alarm. However, any intrusion of the property will immediately energize the local audible alarm for a given period of time in order to indicate to the occupants of the property that an intrusion has occurred. The entrance delay timer is ineffective to prevent the energization of the local audible alarm. The alarm system of the present invention further includes an automatic periodic testing circuit for periodically testing the alarm circuit to determine whether an alarm condition continues to exist. This testing circuit automatically de-energizes the local alarm and the external alarm circuit in the event that the alarm condition has been eliminated. The alarm system of the present invention also includes visual display device located inside the property for indicating to an authorized operator the condition of the alarm circuit. Also, a cable detection alarm circuit is included for detecting the integrity of the cable connecting the alarm circuit to the code combination circuit. A panic button is included for enabling an authorized operator to immediately energize the external alarm.

In the preferred embodiment of the present invention, a numeric keyboard is provided for entering the predetermined code. Visual display means are located in proximity to the numeric keyboard for indicating both the proper entry of the numeric code and the condition of the alarm circuit. A code combination logic circuit is connected to the numeric keyboard for determining whether the proper predetermined code has been entered in the numeric keyboard. The output of the code combination logic circuit is then connected to the alarm circuit for arming and disarming the alarm circuit. The code combination logic circuit includes an internal timer actuated by the first digit of the predetermined code for determining the time period within which the remaining digits of the predetermined code must be entered in the numeric keyboard. Each of these remaining digits must be properly entered in order to actuate a series connection of AND gates and flip-flops located in the code combination logic circuit. The flip-flop associated with the last digit of the predetermined code is a latching flip-flop having an RC timing circuit connected to its input for requiring the authorized operator to actuate the last digit for a predetermined time period in order to trigger the latching flip-flop. This latching flip-flop provides an output signal to the alarm circuit for arming and disarming the alarm circuit. The alarm circuit includes an exit delay timer which is actuated by the output of the latching flip-flop and which in turn actuates a local alarm timer and an extrance delay timer upon expiration of the time period provided by the exit delay timer. A sensing circuit for detecting any intrusion of the property is connected to the alarm circuit to enable the immediate actuation of the local alarm timer and the entrance delay timer upon any intrusion of the property. The local alarm timer energizes the local alarm for a predetermined period of time. The entrance delay timer prevents the energization of the external alarm for a predetermined time period. The alarm system of the present invention can be disarmed by an authorized operator upon returning to the property and entering the proper predetermined code in the numeric keyboard. In this event, the local alarm is energized but the external alarm remains de-energized provided the time period provided by the entrance delay timer has not expired.

DETAILED DESCRIPTION OF THE INVENTION

Figure 1:
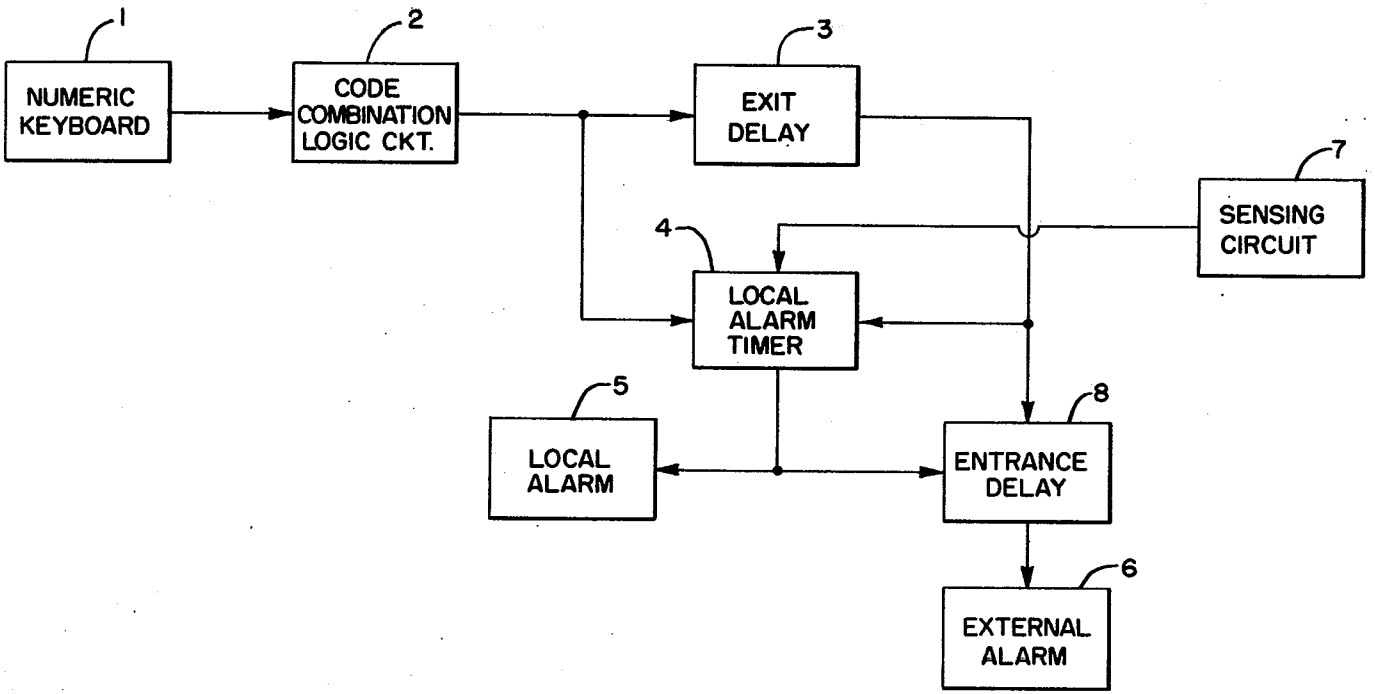
FIG. 1 is a block diagram of the preferred embodiment of the property protection alarm system of the present invention.

The alarm system shows in FIG. 1 illustrate the preferred embodiment of the property protection alarm system of the present invention. This property protection alarm system is armed and disarmed by the entry of a predetermined code within a predetermined period of time in the numeric keyboard 1. The numeric keyboard 1 is connected to the code combination logic circuit 2 which determines whether the proper code is entered in the numeric keyboard. In addition, the code combination logic circuit 2 is capable of determining whether the last digit of the numeric code entered in the numeric keyboard 1 is actuated for a given period of time. The output of the code combination logic circuit 2 supplies voltage to both the exit delay 3 and the local alarm timer 4. The exit delay 3 is also connected to the local alarm timer 4 for delaying the arming of the local alarm timer 4 for a predetermined period of time in order to permit an authorized operator to leave the property without energizing either the local alarm 5 or the external alarm 6. The local alarm timer 4 is responsive to sensing circuit 7 which includes both a normally closed sensing loop and a normally open sensing loop for sensing any alarm condition such as an intrusion of the property. At least one of the sensors in the sensing circuit 7 is associated with a normal entrance to the property so that, after an authorized operator arms the alarm circuit by entering the proper code in the numeric keyboard 1 and leaves the property, the sensing circuit 7 will detect any subsequent intrusion through the normal entrance. The sensing circuit 7 may also include sensors for detecting other types of alarm conditions other than intrusion of the property. The local alarm timer 4 is connected to a local alarm 5 for immediately energizing the local alarm 5 for a predetermined period of time in response to any intrusion of the property detected by the sensing circuit 7. The local alarm timer 4 is also connected to the external alarm 6 through an entrance delay 8 which permits an authorized operator to enter the property and disarm the alarm circuit by entering the proper code in the numeric keyboard 1 before the expiration of the time period provided by the entrance delay 8. In this manner, the external alarm 6 will not be energized by an authorized intrusion of the property provided the proper code is entered in the numeric keyboard 1 within the time period set by entrance delay 8. On the other hand, any intrusion of the property, including an authorized intrusion through the normal entrance, will energize the local alarm 5 which audibly warns occupants of the property of any intrusion. According to the preferred embodiment of the present invention, a plurality of external alarms 6 may be employed, one of which is located immediately outside the property. The other external alarms 6 may be located at a distant station such as a police station or other security center.

Figure 2:
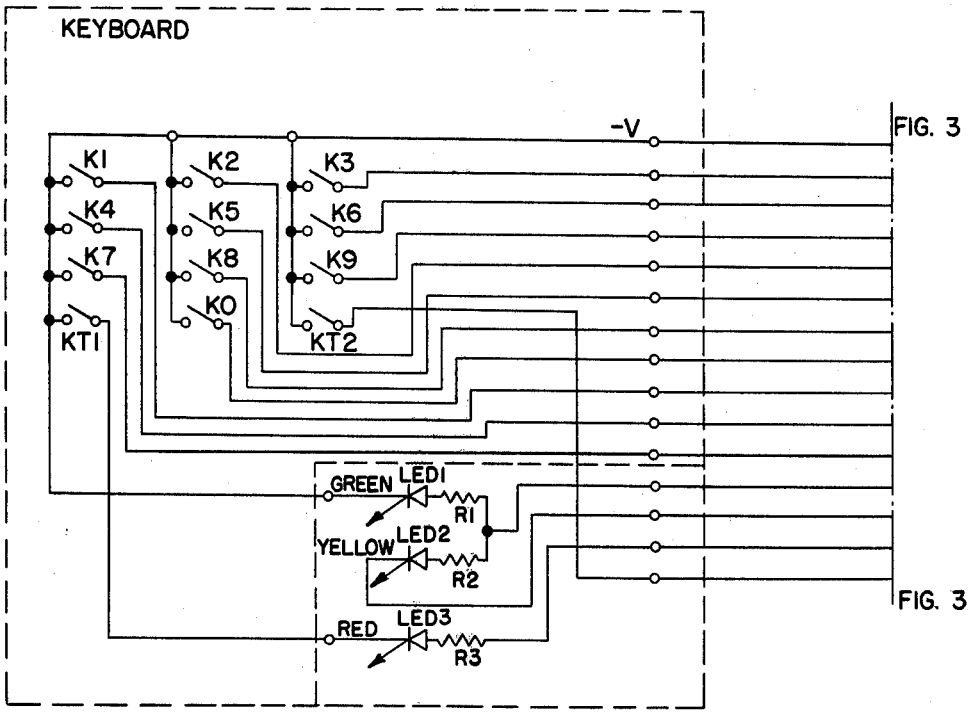
FIG. 2 is a circuit diagram of the numeric keyboard of the present invention including the visual display devices for indicating the condition of the alarm system.

The numeric keyboard of the property protection alarm system of the present invention is shown in FIG. 2. This numeric keyboard is located inside the protected property in a location convenient for the authorized operators of the alarm system. The numeric keyboard includes a plurality of numeric keys K0–K9 and two test keys KT1–KT2. The numeric keys K0–K9 are used for entering the predetermined numeric code assigned to the particular property protected by this alarm system. In the preferred embodiment, the predetermined code consists of five digits which must be activated in sequential order. The test key KT1 in the numeric keyboard is used for testing the condition of the normally closed and the normally open sensing loops contained in the sensing circuit 7 of FIG. 1 and also shown in detail in FIG. 4B. The test key KT2 is used for testing the external alarm circuit. Each of the above numeric keys has one contact connected to a negative voltage source (−V) and another contact connected to different portions of the code combination logic circuit shown in FIG. 3. In addition to these numeric keys, the numeric keyboard has associated therewith a plurality of visual display devices for indicating the condition of the alarm system of the present invention. The green light emitting diode LED1, which together with resistor R1 is connected between the negative voltage source (−V) and the output of the code combination logic circuit shown in FIG 4A, indicates the entry of the proper code in the numeric keyboard. A yellow light emitting diode LED2 and its associated resistor R2 are connected to the output of the exit delay timer circuit, shown in FIG. 4A, to indicate the expiration of the time period provided by the exit delay timer circuit. Thus, the energization of the yellow light emitting diode LED2 indicates that the alarm circuit is armed and that any subsequent change in the condition of the sensing circuit will energize the alarm. The red light emitting diode LED3 and its associated resistor R3 are connected to the negative voltage source (−V) through test key KT1. This diode LED3 indicates the condition of the normally closed and normally open sensing loops of the sensing circuit upon the closing of the contacts of test key KT1.

Figure 3:
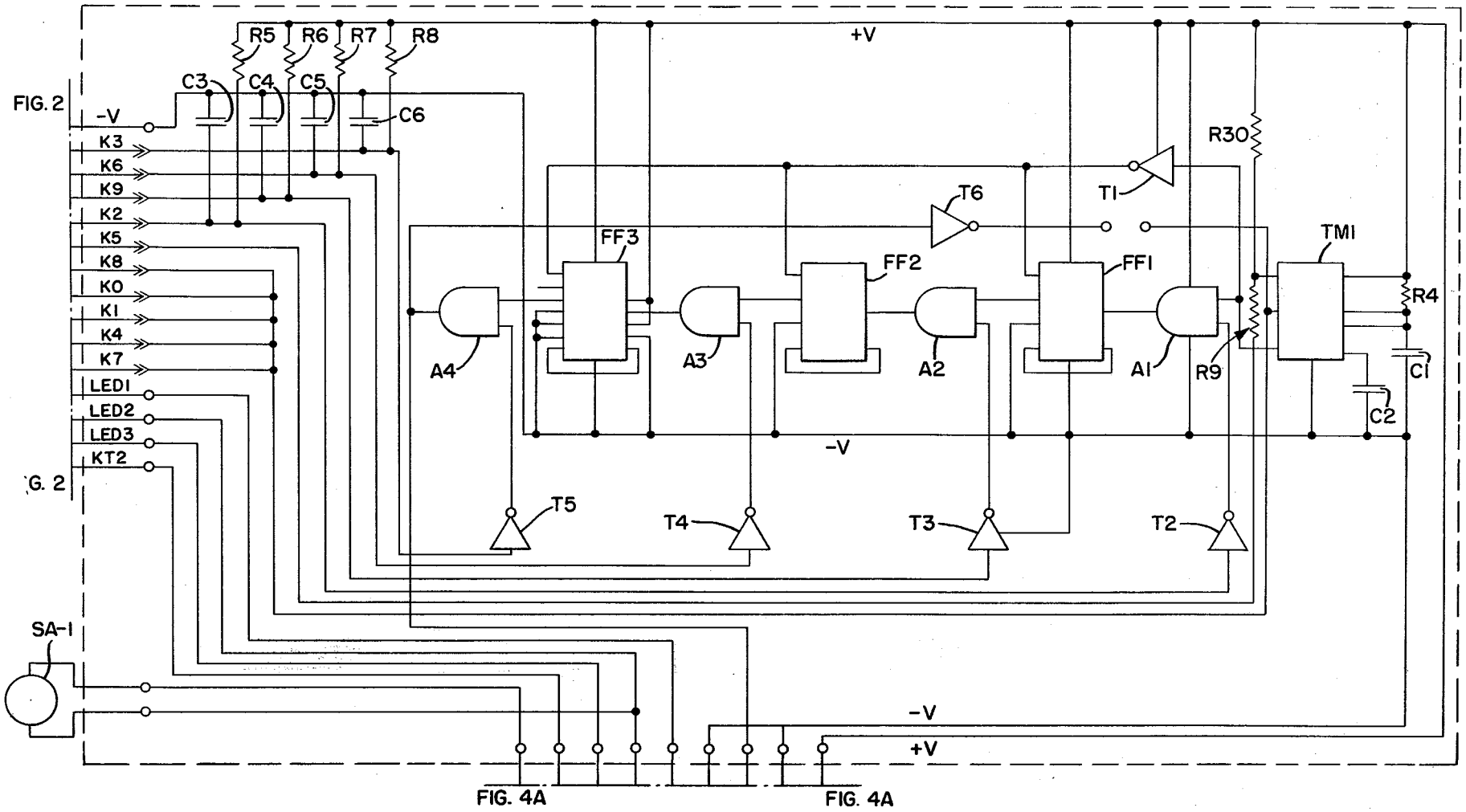
FIG. 3 is a circuit diagram of the code combination of logic circuit except for the output portion.
Figure 4A:
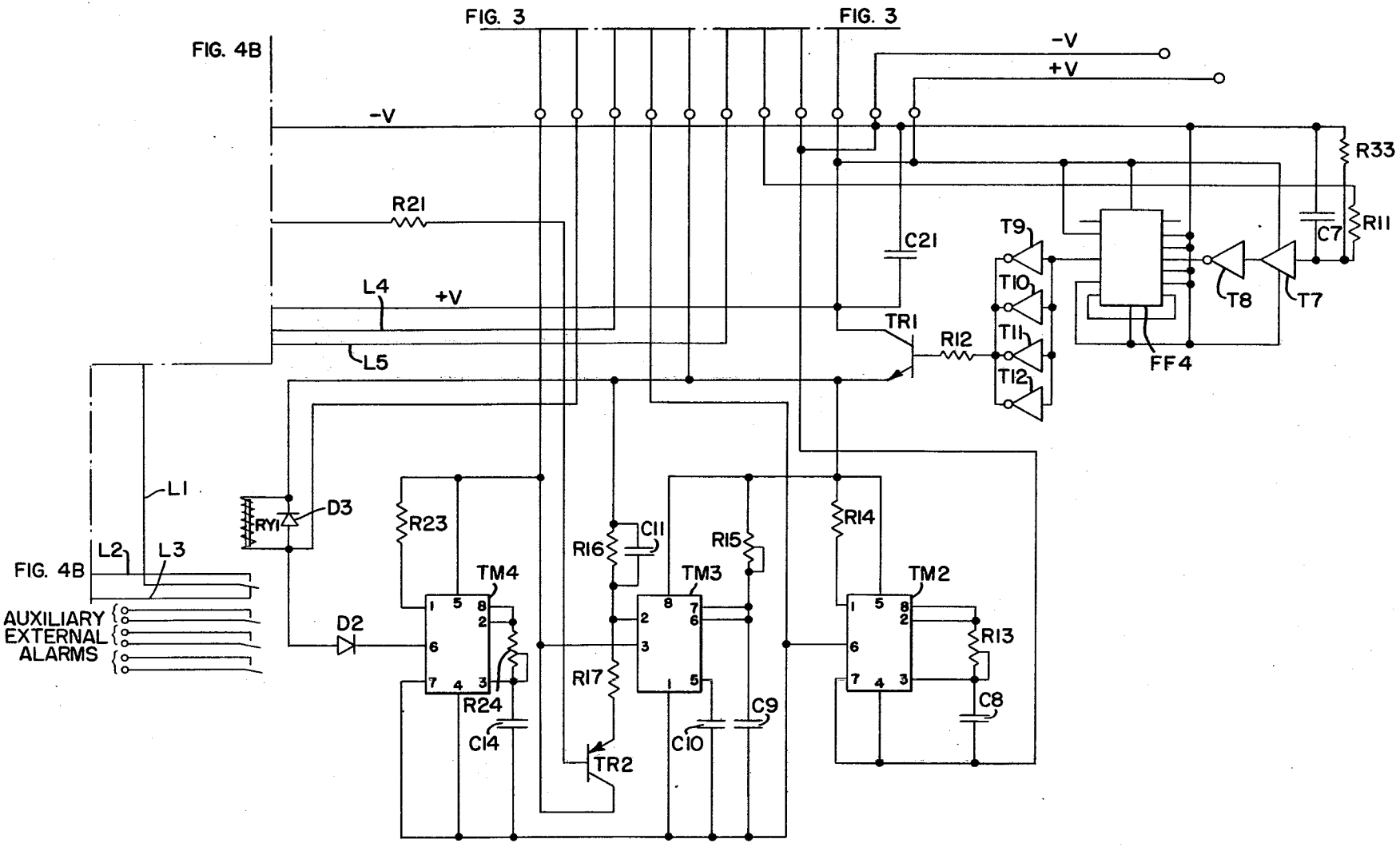
FIG. 4A shows the output portion of the code combination logic circuit and the alarm circuit including the exit delay timer and the entrance delay timer.

The code combination logic circuit is shown in FIG. 3 and a portion of FIG. 4A. As shown in FIG. 3, the numeric keys of the keyboard form the inputs of the code combination logic circuit. Five of these numeric keys (K5, K2, K9, K6 and K3) are individually connected in sequential order to one of five digit logic circuits in the code combination logic circuit. The depression of each one of these numeric keys applies a negative voltage (−V) to the associated digit logic circuits. The numeric key K5 is connected to the input of an interval timer TM1 which sets the predetermined time period within which the remaining digits of the numeric code must be entered in the numeric keyboard. Capacitor C1 and resistor R4 determine the timing period of interval timer TM1. Capacitor C2 holds control voltage on TM1 low. Thus, the first digit represented by the numeric key K5 initiates the timer TM1 which provides a time period such as 5 seconds within which the remaining numeric keys K2, K9, K6 and K3 must be depressed. The output of the interval timer TM1 is connected through a Schmitt trigger T1 to the reset inputs of a plurality of flip-flops FF1-FF3 for resetting these flip-flops before entering the second digit of the numeric code in the keyboard. The output of the interval timer TM1 is also connected to a first input of a first AND gate A1 which has a second input connected to receive the second digit of the numeric code through Schmitt trigger T2. This Schmitt trigger T2 is connected to numeric key K2 in the numeric keyboard. The output of AND gate A1 is connected to the input of flip-flop FF1 which has an output connected to one of the inputs of another AND gate A2. Thus, when the coincidence condition of the AND gate A1 is fulfilled by the depression of numeric key K2 and the output of timer TM1, the flip-flop FF1 changes state and applies a signal to the next digit logic circuit formed by AND gate A2 and flip-flop FF2. All the flip-flops FF1–FF3 are dual type D flip-flops which are connected such that they will only provide an output during the time period provided by interval timer TM1. Thus, the proper numeric code must be entered in the numeric keyboard within the time period provided by interval timer TM1 in order for the code combination logic circuit to generate an output signal for arming and disarming the alarm system.

The second input of AND gate A2 is connected to the numeric key K9 of the numeric keyboard through Schmitt trigger T3. The output of AND gate A2 is connected to the input of flip-flop FF2 which has an output connected to one of the inputs of AND gate A3. Similarly, another input of AND gate A3 is connected to one of the numeric keys of the numeric keyboard, in particular, numeric key K6 through Schmitt trigger T4.

The output of AND gate A3 is then connected to the input of flip-flop FF3 which has an output connected to one of the inputs of AND gate A4. Another input of AND gate A4 is connected to the numeric key K3 through Schmitt trigger T5. Finally, the output of AND gate A4 is connected to the output portion of the code combination logic circuit which is shown in FIG. 4A and described below. The numeric keys which do not form part of the predetermined numeric code, that is, numeric keys K8, K0, K1, K4 and K7 are connected to the reset input of the interval timer TM1. As a result, the interval timer TM1 is automatically reset to its original state whenever an incorrect key, that is, a numeric key not part of the predetermined numeric code, is depressed. The resetting of interval timer TM1 requires the operator of the alarm system to start over again in his attempt to enter the proper numeric code.

The code combination logic circuit described above prevents any unauthorized operator from disarming the alarm system. The depression of any numeric key of the numeric code out of sequential order will make it practically impossible for the unauthorized operator to enter the proper numeric code within the time period provided by interval timer TM1. In addition, the depression of any numeric key which does not form part of the numeric code will automatically reset the interval timer TM1 requiring the unauthorized operator to start again. As described below, the alarm system of the present invention provides only a limited period of time in which to enter the proper numeric code in order to disarm the alarm system and prevent the energization of the external alarm. Thus, it is practically impossible for an unauthorized operator to guess the correct code within the period of time provided in view of the security features provided by the code combination logic circuit.

Each of the numeric keys K5, K2, K9, K6 and K3 forming part of the predetermined numeric code supplies a negative voltage potential to the digit logic circuit associated with that particular numeric key. Biasing resistors R9 and R30 are provided to establish the proper voltage potential at the input of interval timer TM1 upon depression of the numeric key K5. Similarly, biasing resistors R5–R8 and timing capacitors C3–C6 are connected to their respective numeric keys K2, K9, K6 and K3 to eliminate key bounce.

The local alarm SA-1 for the property protection alarm system of the present invention is also shown in FIG. 3. The operation of this alarm will be described below in connection with the circuit shown in FIG. 4A which is connected directly to the local alarm SA-1. The local alarm SA-1 is an audible alarm such as a sonalert. Also as shown in FIG. 3, the connections from the numeric keyboard associated with the light emitting diodes LED1–LED3 and test key KT2 are connected directly to the circuit shown in FIG. 4A and described below.

Although any one of a number of known timers can be used for the interval timer TM1 described above, it is preferable that the interval timer TM1 be one of several available integrated circuit timers. For example, a standard interval timer such as integrated circuit type number LM555 may be used. The flip-flops FF1–FF3 shown in FIG. 3 also may be any one of a number of known type D flip-flops. In the preferred embodiment, a type CD4013 dual D flip-flop is used. Again, the Schmitt triggers TI–T6 may be any one of a number of known Schmitt triggers although in the preferred embodiment hex Schmitt triggers of the type LM74C14 produced by National Semiconductor Corporation are employed.

The output stage of the code combination logic circuit is shown in a portion of FIG. 4A. The output of AND gate A4 of FIG. 3 connected to flip-flop FF4 through Schmitt triggers T7 and T8. The flip-flop FF4 changes state in response to the output provided by AND gate A4. In addition, the circuit connecting AND gate A4 and flip-flop FF4 includes an RC timing network consisting of resistor R11, resistor R33 and capacitor C7. The purpose of this RC network is to establish a time period during which the numeric key associated with the last digit of the predetermined code must be depressed in order for the flip-flop FF4 to change state. In other words, in the preferred embodiment, the numeric key K3 must be depressed for a predetermined time period such as one second as determined by resistor R11, resistor R33 and capacitor C7. The purpose of this time period is not only to provide additional code identification, but also to guard against the false arming and disarming of the alarm system due to transient signals. The output of the flip-flop FF4, which changes state in response to a signal supplied through the above RC network and Schmitt triggers T7–T8, is the output of the code combination logic circuit. Thus, the output stage of the code combination logic circuit is formed by the RC network including resistor R11, resistor R33 and capacitor C7, the flip-flop FF4 and the Schmitt triggers T7–T8. The flip-flop FF4 and the Schmitt triggers T7–T8 are similar in design to the flip-flops FF1–FF3 and the Schmitt triggers T1–T6 described above.

The alarm energization circuit of the present invention includes the switching transistor TR1 which is turned on by the output of the code combination logic circuit supplied through biasing resistor R12 and Schmitt triggers T9–T12 from the flip-flop FF4. The Schmitt triggers T9–T12 are connected in parallel in order to increase the switching current for switching transistor TR1. A capacitor C21 is connected to the collector of switching transistor TR1 to protect against transient signals. The turning on of switching transistor TR1 connects the positive voltage source (+V) to the timers TM2–TM3 and the alarm relay RY1. The timer TM2 is the exit delay timer which is immediately actuated upon turning on switching transistor TR1. The exit delay timer TM2 is connected to the emitter of switching transistor TR1. Positive trigger voltage is supplied through resistor R14. A timing circuit for the exit delay timer TM2 is provided by resistor R13 and capacitor C8. The output of the exit delay timer TM2, which is connected to the power inputs of timer TM3 and TM4, is normally high and switches to a low condition upon the expiration of the time period provided by the exit delay timer TM2. Thus, the exit delay timer TM2 supplies a low signal to timers TM3–TM4 which prepares these timers for operation in the event an alarm condition is sensed by the sensing circuit of the alarm system. The output of the exit delay timer TM2 is also connected to one terminal of the local alarm SA-1 shown in FIG. 3. Thus this local alarm SA-1 is prepared for immediate energization upon the occurrence of an alarm condition such as any intrusion of the property. Although the exit delay timer TM2 may be any one of a number of known timers, in the preferred embodiment, the timer TM2 is an integrated circuit timer type LM3905 manufactured by National Semi-Conductor Corp.

The switching transistor TR1 also connects the positive voltage source (+V) to the timer TM3. Although the timer TM3 may be any one of a number of known timers, in the preferred embodiment, the timer TM3 is a standard integrated circuit timer type LM555. The emitter of switching transistor TR1 is connected to the timer TM3 through an RC timing circuit including resistor R15 and capacitor C9 which determines the timing period of timer TM3. The capacitor C10 is connected to timer TM3 to hold control voltage low. The switching transistor TR1 is also connected to the trigger input of the timer TM3 through the RC network including resistor R16 and capacitor C11. Thus, this trigger input is normally positive when the alarm energization circuit is armed by the turning on of switching transistor TR1. The trigger input of the timer TM3 is also connected through resistor R17 to the emitter PNP switching transistor TR2. This switching transistor TR2 is normally turned off because the base of this switching transistor TR2, which is connected to the sensing circuit shown in FIG. 4B, does not receive a negative or low signal in the absence of an alarm condition. The output of the timer TM3 is connected to the collector of switching transistor TR2, the other terminal of the local alarm SA-1 and the timer TM4. The output of the timer TM3 is normally low when the trigger input is connected to the positive voltage potential (+V) through switching transistor TR1 and RC network R16 and C11. Thus, the timer TM3 prepares the switching transistor TR2 for receiving a negative or low signal from the sensing circuit by holding the collector of switching transistor TR2 low. At the same time, the emitter of switching transistor TR2 is high due to the positive voltage potential (+V) supplied through switching transistor TR1 and RC network R16 and C11.

Upon occurrence of an alarm condition, the sensing circuit provides a low signal to the base of switching transistor TR2 through biasing resistor R21 which turns on switching transistor TR2. The turning on of switching transistor TR2 provides a negative trigger signal to the trigger input of the timer TM3 through the emitter of switching transistor TR2. This low trigger input to timer TM3 actuates the timer TM3 for the period determined by the timing circuit R15 and C9. For example, in the preferred embodiment, this timing interval is approximately 5 minutes. In response to the negative trigger input, the timer TM3 immediately switches its output from the low state of the high state and holds this high state until the expiration of the time period provided by the timer TM3. The high stage of the output of timer TM3 immediately turns off switching transistor TR2 which prepares switching transistor TR2 for receiving additional signals from the sensing circuit upon the expiration of the time period provided by timer TM3. Thus, the switching transistor TR2 is only turned on for an instant upon the occurrence of an alarm condition. Upon the expiration of the time period determined by the RC timing circuit R15 and C9 connected to the timer TM3, the switching transistor TR2 will again test the sensing circuit to determine whether the alarm condition which initially triggered the switching transistor TR2 continues to exist. In this manner, the timer TM3 enables the alarm energization circuit to periodically test the condition of the sensing circuit.

As stated above, the output of the timer TM3 is also connected directly to the local alarm SA-1 shown in FIG. 3. The occurrence of a high output on the output of timer TM3 immediately energizes the local alarm SA-1. This alarm remains energized for the time period determined by the timer TM3 and the timing circuit R15 and C9. However, if the alarm condition which initially turned on the switching transistor TR2 continues to exist upon the expiration of the time period of timer TM3, a negative trigger input will again be applied to the timer TM3 and the timing cycle of timer TM3 and timing circuit R15 and C9 will be repeated. Thus, according to the present invention, the timer TM3 and its associated circuitry is capable of determining whether the alarm condition initially sensed by the sensing circuit continues to exist. If the alarm condition continues to exist, the local alarm SA-1 will remain energized for an additional time period determined by the timer TM3 and the timing circuit R15 and C9. This cycle repeats itself until the alarm condition detected by the sensing circuit is eliminated.

The output of the timer TM3 is also connected to both the trigger input and the positive voltage inputs of the timer TM4. Positive trigger voltage is supplied through resistor R23. The low voltage inputs of entrance delay timer TM4 are connected to the output of exit delay timer TM2. Thus, the entrance delay timer TM4 is prepared for actuation by the outputs of both the exit delay timer TM2 and the timer TM3. Although the timer TM4 may be any one of a number of known timers, in the preferred embodiment, the timer TM4 is an integrated circuit timer type LM3905 manufactured by National Semiconductor Corporation. The timing period of entrance delay timer TM4 is determined by the timing circuit formed by resistor R24 and capacitor C14. The output of entrance delay timer TM4 is connected to the alarm relay RY1 through blocking diode D2. The output of entrance delay timer TM4 is normally high and remains in the high state until the expiration of the timer period provided by the entrance delay timer TM4. The output of the entrance delay timer TM4 then goes low to energize the alarm relay RY1 through the switching transistor TR1 which is connected by its collector to the positive voltage source (+V). A protective diode D3 also is connected across the relay coil of relay RY1. The relay RY1 has a plurality of normally open contacts which are connected to a plurality of external alarms. These contacts close to energize these external alarms upon energization of the relay RY1 by the entrance delay timer TM4.

One side of the relay of the alarm relay RY1 also is connected directly to test key KT2 in the numeric keyboard shown in FIG. 2. The test key KT2 is normally in the open position. The depression of the test key KT2 connects the negative voltage potential (−V) to one side of the relay coil of the alarm relay RY1, the other side of which is connected to the positive voltage potential (+V) through the switching transistor TR1. Thus, upon depression of the test key KT2 after the switching transistor TR1 is turned on due to the entrance of the numeric code in the numeric keyboard, the external alarms connected to the relay contacts of the alarm relay RY1 can be tested for proper operation.

Figure 4B:
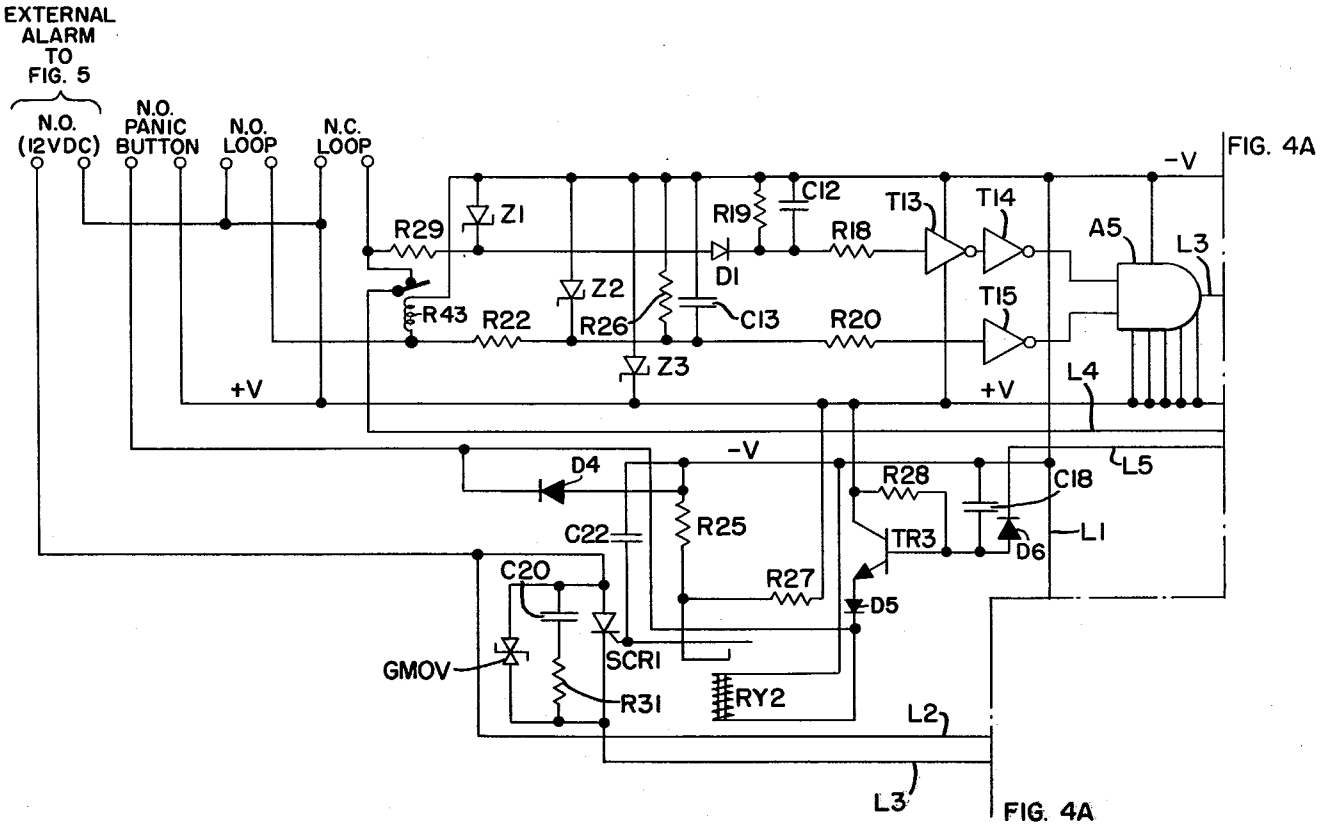
FIG. 4B shows the sensing circuit for sensing alarm conditions including a normally closed sensing loop and a normally open sensing loop.

The sensing circuit of the alarm system of the present invention is shown in detail in FIG. 4B. In addition, the circuit shown in FIG. 4B includes a circuit for connecting one of the external alarms to the alarm relay contacts shown in FIG. 4A. This particular external alarm is shown in further detail in FIG. 5. The circuit shown in FIG. 4B also includes a cable protection alarm circuit and a panic button alarm circuit.

As shown in FIG. 4B, the sensing circuit includes a normally open sensing loop and a normally closed sensing loop. These loops include a plurality of sensors for detecting alarm conditions such as any intrusion of the property. For example, if the alarm system is used in a residence, normally closed sensing switches associated with the doors and windows of the residence may be included in the normally closed loop. Additionally normally open sensing switches may be included in the normally open loop. One terminal of the normally closed loop is connected to the positive voltage source (+V) and, as a result, a positive potential is supplied through the normally closed loop to one input of the AND gate A5 through the Schmitt triggers T13 and T14. In the preferred embodiment, the Schmitt triggers T13 and T14 are preferably of the standard type LM74C14. The biasing resistors R29 and R18 and the blocking diode D1 for protecting against negative voltage spikes are connected between the normally closed loop and the input of Schmitt trigger T13. The output of the Schmitt trigger T13 is low and thus the output of the Schmitt trigger T14 is high. The circuit connected between the normally closed loop and the first input of the AND gate A5 also includes a Zener diode Z1 for suppressing transient signals and an RC network including resistor R19 and capacitor C12 for providing a slight delay after the triggering of the sensing circuit in order to prevent false triggering of the alarm system.

The other input of the AND gate A5 is connected to the normally open loop through Schmitt trigger T15 which is similar in design to Schmitt triggers T13 and T14. Biasing resistors R20 and R22 are connected between the input of the Schmitt trigger T15 and the normally open loop. In addition, Zener diodes Z2 and Z3 are provided for suppressing transient voltage signals. A negative voltage potential is supplied to the input of the Schmitt trigger T15 when the normally open loop is in its normally open condition through the RC network including resistor R26 and capacitor C13. The capacitor C13 provides a slight time delay after the tripping of the normally open sensing loop to prevent false triggering of the alarm system. As a result of the negative voltage potential supplied to the input of the Schmitt trigger T15, the second input of the AND gate A5 is also normally high. Thus, when the sensors in the normally open sensing loop are in the open condition and the sensors in the normally closed sensing loop are in the closed condition, both inputs of the AND gate A5 are high. This results in a high output signal for AND gate A5 which prevents the turning on of PNP switching transistor TR2 shown in FIG. 4A and described above. On the other hand, the closing of one or more of the sensors in the normally open loop supplies a positive voltage potential to the input of Schmitt trigger T15 which then in turn supplies a low signal to one input of the AND gate A5. The AND gate A5 then supplies a low signal to the base of PNP switching transistor TR2 in FIG. 4A which turns on switching transistor TR2 and energizes the alarm energization circuit. Similarly, the opening of one or more of the normally closed sensors in the normally closed sensing loop disconnects the positive voltage potential (+V) from the circuit connected to the other input of AND gate A5 resulting in a low signal being applied to this input of AND gate A5. As described above, the AND gate A5 then supplies a low signal to the switching transistor TR2 shown in FIG. 4A.

The normally open sensing loop and the normally closed sensing loop are connected through line L4 to the test key KT1 in the numeric keyboard through the light emitting diode LED3 (FIG. 2). The test key KT2 is normally in the open position. Upon depression of the test key KT2, the negative voltage potential (−V) is connected to both the normally open sensing loop and the normally closed sensing through test relay RY3 and through the light emitting diode LED3. If both these sensing loops are in their normal condition, that is, the sensors in the normally open loop are in their open position and the sensors in the normally closed loop are in their closed position, the light emitting diode LED3 is energized to indicate the normal condition of these sensing loops.

As shown in FIG. 4B, a cable protection circuit is also provided for protecting the integrity of the cable connecting the circuit of FIG. 4B and the code combination logic circuit of FIG. 3. Line L5 in FIGS. 4A and 4B is connected to the negative voltage (−V) through the cable connecting the code combination logic circuit of FIG. 3 to the circuit of FIGS. 4A and 4B. The negative voltage on this line L5 through blocking diode D6 normally turns off NPN switching transistor TR3 which has its base connected directly to line L5. The collector of switching transistor TR3 is connected to the positive voltage source (+V). A timing capacitor C18 and a biasing resistor R23 provide transient protection for TR3. The emitter of switching transistor TR3 is connected through diode D5 through normally de-energized relay RY2 to the negative voltage source (−V). The cutting of the cable disconnects the negative voltage (−V) from the base of the switching transistor TR3 which permits transistor TR 3 to turn on which in turn energizes the relay RY2. The closing of the relay contact associated with relay RY2 triggers SCR1 which connects the negative voltage source (−V) to the external alarm as shown in FIG. 4B. A positive voltage (+V) is normally applied to the other terminal of the external alarm and thus the triggering of SCR1 energizes this external alarm. The negative voltage (−V) connected by the SCR1 to the external alarm is supplied through one of the normally closed relay contacts of the alarm relay RY1 (lines L1 and L3). Another line L2 is also connected between these relay contacts and this external alarm so that the normal energization of alarm relay RY1 due to an alarm condition will also energize this external alarm. The gate of the SCR1 is biased by biasing resistor R25 and R27 and a capacitor C22 is connected to the gate to prevent the SCR1 from false triggering. In addition, the series connection of resistor R31 and capacitor C20 together with diode GMOV connected across the anode and cathode of SCR1 prevent the SCR1 from false triggering due to transient signals.

As shown in FIG. 4B, a normally open panic button or switch for manual operation by the operator of the alarm system is connected between the positive voltage source (+V) and the relay RY2. The closing of the panic button causes the energization of the relay RY2 which closes the relay contacts connected to the gate of SCR1. A diode D4 is also connected between the normally open panic button and the gate of SCR1 to provide transient protection. The closing of the relay contacts of relay RY2 triggers the SCR1 in the manner described above which energizes the external alarm connected to the circuit shown in FIG. 4B and described in further detail in FIG. 5. After closing the panic button to energize the external alarm, operator of the alarm system can turn off the external alarm by first entering the proper numeric code in the numeric keyboard of FIG. 2, then depressing the test key KT2 in the numeric keyboard which energizes alarm relay RY1, and then again entering the proper numeric code in the numeric keyboard to de-energize the alarm system. The entry of the numeric code in the numeric keyboard turns on switching transistor TR1 in the alarm energization circuit of FIG. 4A which provides a positive voltage potential to the alarm relay RY1. The closing of the test key KT2 supplies the negative voltage potential to the other side of the alarm relay RY1 which energizes the alarm relay RY1 and opens the normally closed contact of alarm relay RY1 which is connected directly to the SCR1 shown in FIG. 4B. This de-energizes the panic button circuit described above. Finally, the reentry of the proper numeric code in the numeric keyboard then turns off the switching transistor TR1 which de-energizes the alarm relay RY1 which in turn de-energizes the external alarm connected to the circuit shown in FIG. 4B.

Figure 5:
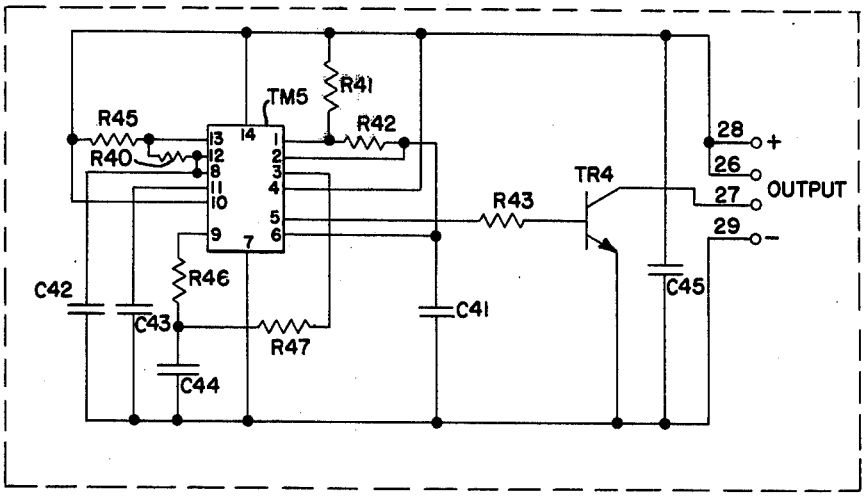
FIG. 5 shows an audible alarm circuit connected to the circuit shown in FIG. 4B which may be used as one of the external alarms of the alarm system of the present invention.

FIG. 5 shows an external alarm circuit connected to the external alarm terminals shown in FIG. 4B. The positive voltage input of this external alarm circuit is connected to the positive voltage source (+V) in FIG. 4B and the negative is connected to the negative voltage source (−V) in FIG. 4B as described above. The circuit shown in FIG. 5 generates an oscillating output which enables an audible alarm connected to the output terminals of the circuit of FIG. 5 to produce a wailing sound. This circuit includes a dual timing chip TM5 such as a standard integrated circuit timer type LM556 which essentially includes two similar timing chips mounted in a single integrated circuit package. The triggering of the SCR1 of FIG. 4B or the energization of the alarm relay contacts of alarm relay RY1 actuates the dual timing chip TM5. Resistors R45, R40, and capacitor C42 form the first RC network for the first half of the dual timer. Resistors R41, R42 and capacitor C41 form the second RC network for the second half of the dual timer. The RC network including resistors R46 and R47 and capacitor C44 connect the two halves of the dual timer. Capacitor C43 holds the control voltage low. The output of the dual timer TM5 is connected to output transistor TR4 through biasing resistor R43. The output of transistor TR1 varies in accordance with the oscillation of the circuit associated with dual timer TM5. As a result, the audio alarm connected to the output of output transistor TR4 generates a wailing sound which is intended to frighten intruders away. To this end, this audio alarm may be located immediately adjacent the property protected by the alarm system in order to both frighten away any potential intruder and warn others in the vicinity of an alarm condition.

The operation of the property protection alarm system of the present invention has been described in connection with the detailed discussion of the circuit components of FIGS. 2–5. Briefly, an authorized user of the property protection alarm system enters the proper numeric code combination in the numeric keyboard of FIG. 2 which lights a visual display device located at the numeric keyboard to indicate the proper entry of the numeric code combination. The numeric code must be entered in the numeric keyboard within a given predetermined period of time and the last key associated with the last digit of the numeric code must be depressed for a given period of time. The code combination logic circuit of FIG. 3 and FIG. 4A then generates an output signal which enables the alarm energization circuit of FIG. 4A and triggers the exit delay timer. The entry of an incorrect numeric code in the numeric keyboard will not only fail to generate the required output, but will also automatically reset the code combination logic circuit. Upon the expiration of the time period provided by the exit delay timer, another visual display device is energized at the numeric keyboard to indicate that the alarm system is now prepared to detect any intrusion. In addition, the exit delay timer prepares the entrance delay timer and the local alarm timer for operation. A sensing circuit connected to the alarm energization circuit provides a signal indicating the condition of both a normally closed sensing loop and a normally open sensing loop. Upon any intrusion of the property, a signal is sent to the alarm energization circuit which immediately triggers the local alarm timer which in turn immediately energizes the local alarm connected thereto for a given time interval determined by the timing period of the local alarm timer. The local alarm timer also triggers the entrance delay timer which controls the operation of the alarm relay of the alarm energization circuit. Upon expiration of the time period provided by the entrance delay timer, the alarm relay is energized and closes its alarm relay contacts to energize the external alarm circuits. The energization of the external alarm circuits can be prevented by an authorized operator by entering the proper numeric code in the numeric keyboard within the time period provided by the entrance delay timer. As a result of the entrance of the proper numeric code, the code combination logic circuit provides a signal to the alarm energization circuit which disarms the alarm energization circuit and prevents the energization of the alarm relay and the external alarm circuits.

Although illustrative embodiments of the present invention have been described in detail with reference to the accompanying drawings, it is to be understood that the invention is not limited to those precise embodiments and that various changes and modifications may be effected therein by one skilled in the art without departing from the scope or spirit of the invention. For example, the alarm system of the present invention may also be used to detect alarm conditions other than intrusion of the property. In addition, any one of a number of known external alarms may be employed with the alarm system of the present invention.

I claim:

1. A property protection alarm system for protecting property against unauthorized intrusion and the like comprising:

sensing means for sensing an alarm condition such as any intrusion of the property, said sensing means including means for detecting movement through normal entrance to the property;

a local audible alarm;

an external alarm;

alarm energization means responsive to said sensing means for energizing said local audible alarm for a given alarm interval upon the occurrence of any intrusion of the property including an authorized intrusion through said normal entrance and energizing said external alarm only after a predetermined entrance delay period;

arming means connected to said alarm energization means for enabling an authorized user of said alarm system to arm and disarm said alarm energization means, said arming means including a numeric keyboard having a plurality of keys and a code combination logic circuit connected thereto for arming and disarming said alarm energization means in response to a predetermined numeric code entered in said numeric keyboard by actuation of selected ones of said keys, said code combination logic circuit including code timing means responsive to the actuation of the first of said selected ones of said keys associated with the predetermined numeric code for establishing a predetermined code interval in which all of the remaining ones of said selected ones of said keys associated with the predetermined numeric code must be actuated in order to arm or disarm said alarm energization means;

said alarm energization means including exit delay means actuated by said arming means for delaying only the arming of said alarm energization means by said arming means for a predetermined exit delay period to permit the authorized user of said alarm system to leave the property through said normal entrance without energizing either said local audible alarm or said external alarm, said alarm energization means further including entrance delay means connected to said external alarm for delaying energization of said external alarm for the predetermined entrance delay period to permit the authorized user to enter the property through said normal entrance without energizing said external alarm and disarm said alarm system by actuating said arming means, said local audible alarm being immediately energized for a given alarm interval in response to any intrusion of the property including an authorized intrusion through said normal entrance.

2. An alarm system as claimed in claim 1 wherein said code combination logic circuit includes digital timing means responsive to the actuation of a predetermined one of said selected ones of said keys in said numeric keyboard, said digital timing means having a timing period during which said predetermined one of said selected ones of said keys associated with a predetermined one of the digits in the predetermined numeric code must be continuously activated in order for said code combination logic circuit to arm or disarm said alarm energization means.

3. An alarm system as claimed in claim 1 wherein said code combination logic circuit further comprises a number of sequentially actuated digital logic circuits corresponding to the number of said remaining ones of said keys associated with the predetermined numeric code, each of said digital logic circuits being responsive to the actuation of one of said remaining ones of said keys in said numeric keyboard, the first of said digital logic circuits being actuated by said code timing means and the last of said digital logic circuits being responsive to the actuation of the last one of said selected ones of said keys associated with the last digit of the predetermined numeric code to arm or disarm said alarm energization means.

4. An alarm system as claimed in claim 3 wherein each of said digital logic circuits includes an AND gate having one input connected to a predetermined one of the numeric keys of said keyboard and having an output connected to the input of an associated flip-flop, wherein each of said flip-flop is conditioned by said code timing means for acceptance of said AND gate output for the predetermined code interval, wherein the AND gate of the first of said digital logic circuits has another input connected to the output of said code timing means and each AND gate of the other of said digital logic circuits has another input connected to the output of the flip-flop associated with the AND gate of the preceding digital logic circuit to thereby cause each of said flip-flops to change state in sequential order in response to the fulfillment of the coincidence condition of the associated AND gate.

5. An alarm system as claimed in claim 3 wherein said code timing means is reset by the actuation of any numeric key in said numeric keyboard other than said selected ones of said numeric keys associated with the predetermined numeric code.

6. An alarm system as claimed in claim 1 wherein said alarm energization means comprises a local alarm timer connected to said sensing means for immediately energizing both said local audible alarm for the given alarm interval and said entrance delay means upon any intrusion of the property, said alarm energization means further including an alarm relay connected to said entrance delay means for energizing said external alarm upon expiration of the predetermined entrance delay period provided by said entrance delay means, said alarm relay having relay contacts connected to said external alarm for energizing said external alarm upon actuating said relay contacts.

7. An alarm system as claimed in claim 6 wherein said alarm energization means further comprises timing means connected to said local alarm timer for enabling said local alarm timer to periodically test said sensing means after energization of said local audible alarm to determine the continued existence of an alarm condition, said timing means enabling said local alarm timer to de-energize said local audible alarm when said alarm condition is eliminated.

8. An alarm system as claimed in claim 7 wherein said sensing means comprises an AND gate having one input connected to a normally open sensing loop and another input connected to a normally closed sensing loop, the output of said AND gate being connected to the input of said local alarm timer through a switching transistor, whereby said switching transistor changes state for an instant in response to an alarm condition to trigger said local alarm timer, said switching transistor immediately returning to its original state.

9. An alarm circuit as claimed in claim 8 further comprising first testing means for testing and indicating the condition of said normally open sensing circuit and said normally closed sensing circuit and second testing means for testing said external alarm.

10. An alarm circuit as claimed in claim 1 wherein said sensing means further comprises a manual panic button for energizing said external alarm, a cable connecting said alarm energization means to said arming means and cable protection means connected to said external alarm for protecting the integrity of said cable, said cable protection means being responsive to the cutting and/or disconnecting of said cable to energize said external alarm.

* * * * *